United States Patent [19]

Watanabe

[11] 3,984,720

[45] *Oct. 5, 1976

[54] DISCHARGE DISPLAY DEVICE

[75] Inventor: Satoshi Watanabe, Gyoda, Japan

[73] Assignee: Okaya Denki Sangyo Kabushiki Kaisha, Japan

[ * ] Notice: The portion of the term of this patent subsequent to June 1, 1993, has been disclaimed.

[22] Filed: Mar. 24, 1975

[21] Appl. No.: 561,300

[30] Foreign Application Priority Data

Mar. 25, 1974 Japan ..... 49-33225

[52] U.S. Cl. ..... 313/220; 313/188

[51] Int. Cl.[2] ..... H01J 61/30

[58] Field of Search ..... 313/220, 188, 201

[56] References Cited

UNITED STATES PATENTS 3,863,087 1/1975 Holz ..... 313/188

*Primary Examiner*—Siegfried H. Grimm
*Assistant Examiner*—Darwin R. Hostetter
*Attorney, Agent, or Firm*—Hill, Gross, Simpson, Van Santen, Steadman, Chiara & Simpson

[57] ABSTRACT

A discharge display device is disclosed which has upper and lower plates at least one of which is made transparent, a spacer disposed between said upper and lower plates, at least one cathode and at least one anode disposed between said spacer and said upper plate in opposed relation to said cathode, an adhesive agent sealing said upper and lower plates in an air-tight manner along their outer edges to form an envelope and an inert gas sealed within said envelope. In this case, at least said spacer is covered with an insulating porous layer.

7 Claims, 11 Drawing Figures

DISCHARGE DISPLAY DEVICE

BACKGROUND OF THE INVENTION

1. Field of the Invention

This invention relates generally to a discharge display device, and more particularly to a discharge display device employing a novel spacer.

2. Description of the Prior Art

In the prior art, discharge display device in which the response time interval is short and a discharge between a pair of the cathode and anode is rapidly transferred to another pair of the cathode and anode of the discharge display device are not known.

Accordingly, the prior art discharge display device can not be used in place of a Braun tube.

SUMMARY OF THE INVENTION

According to an aspect of this invention there is proposed a discharge display device which consists of upper and lower plates at least one of which is made transparent, a spacer disposed between said upper and lower plates, a plurality of cathodes disposed side by side between said spacer and said lower plate and selectively supplied with a voltage, a plurality of anodes disposed side by side between said spacer and said upper plate in opposed relation to said plurality of cathodes, an adhesive agent sealing said upper and lower plates in air-tight manner along their outer edges, and an inert gas sealed within said upper and lower plates, at least said spacer being covered with an insulating porous layer.

Accordingly, it is an object of this invention to provide a novel discharge display device.

It is another object of the invention to provide a discharge display device which has a short response time.

It is a further object of the invention to provide a discharge display device in which a discharge between a pair of the cathode and anode can be rapidly transferred to another pair of cathodes and anodes.

It is a yet further object of the invention to provide a discharge display device employing a novel spacer.

It is a still further object of the invention to provide a discharge display device which can be used in place of a Braun tube.

The other objects, features and advantages of the invention will become apparent from the following description taken in conjunction with the accompanying drawings.

DESCRIPTION OF THE PREFERRED EMBODIMENT

With reference to the drawings, an embodiment of this invention will hereinafter be described.

Figure 1A:
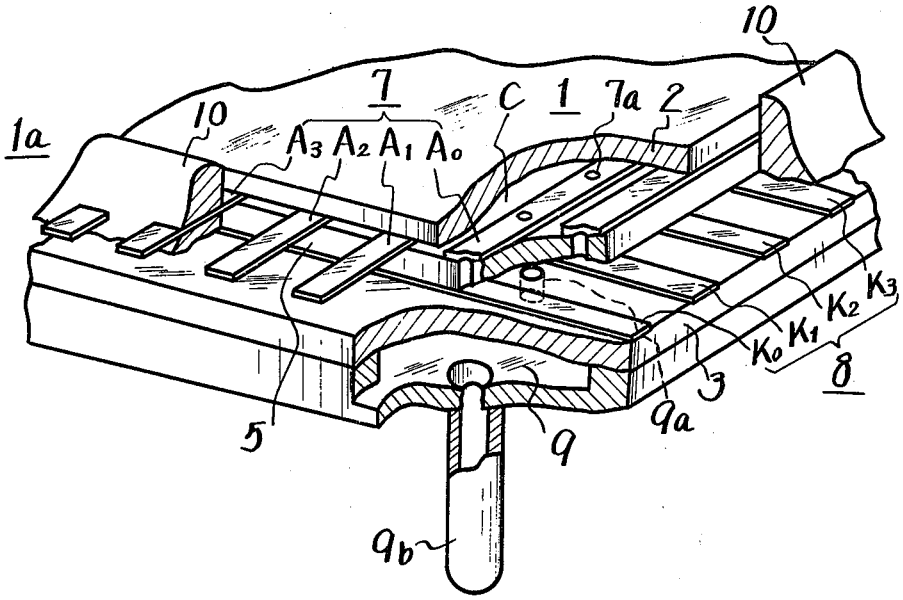
FIG. 1A is a fragmentary perspective view, partly in cross-section, showing one example of the discharge display device according to this invention.

FIG. 1A is a fragmentary perspective view showing, partly in cross-section, a discharge display device in accordance with one embodiment of this invention.

Figure 1B:
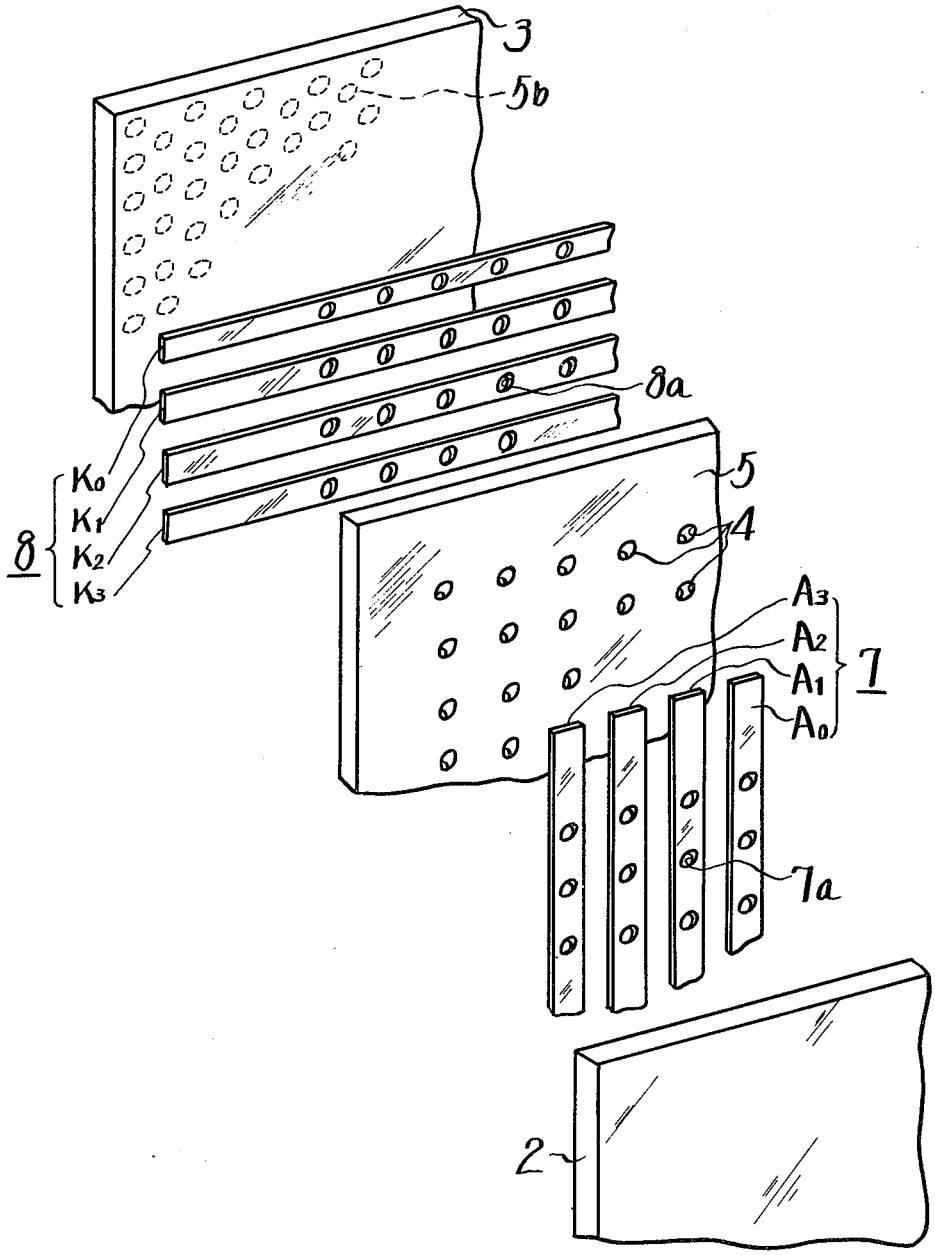
FIG. 1B is an exploded perspective view, partly cut away, showing the principal part of the example depicted in FIG. 1A.

FIG. 1B is an exploded perspective view showing the principal part of the discharge display device exemplified in FIG. 1A.

In FIGS. 1A and 1B, reference numeral 1 indicates generally a discharge display device. The discharg display device 1 comprises upper and lower insulatin plates 2 and 3 which are disposed in opposing relati to each other and at least one of which is formed o transparent material such, for example, as glass, and insulative spacer 5 which has bored therethroug plurality of apertures 4 in a matrix manner (refe FIG. 1B) and is disposed between the upper and l insulating plates 2 and 3. Between the upper pl which is transparent in this embodiment, an spacer 5, there is disposed an anode 7 which i posed of a plurality of plate-shaped strip ano ments $A_0$, $A_1$, $A_2$, - - - and $A_n$. In this case, th elements $A_0$, $A_1$, $A_2$, - - - and $A_n$ are disposed side in opposing relation to the columns of t tures 4 bored in the spacer 5 in a matrix form. the lower plate 3 and the spacer 5, there is c cathode 8 which is composed of a pluralit shaped strip cathode elements $K_0$, $K_1$, - - - a cathode elements $K_0$, $K_1$, - - - and $K_n$ are di by side in opposing relation to the rows of t 4 bored in the spacer 5. Thus, the cathode $K_1$, - - - and $K_n$ cross the anode elements A $A_n$ at right angles thereto, respectively.

After assembling of the above said par ture such as shown in FIG. 1A, their pe are sealed by means of an adhesive 10, s or the like to provide an envelope 1*a*. T is evacuated through an exhaust pipe inert gas such as neon, xenon, argon like is sealed in the envelope 1*a* thr pipe 9*b*, thus providing the discharg Of course, the exhaust pipe 9*b* is sea of the inert gas in the envelope 1*a*.

Figure 2A:
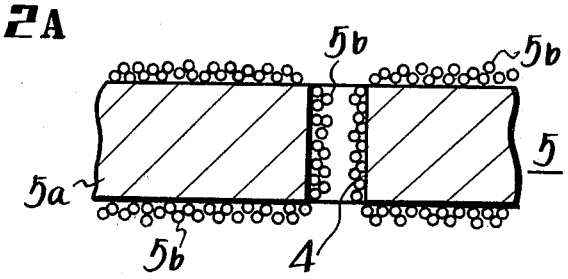
FIG. 2A is a fragmentary cross sectional view of a spacer employed in the example shown in FIG. 1A.
Figure 2B:
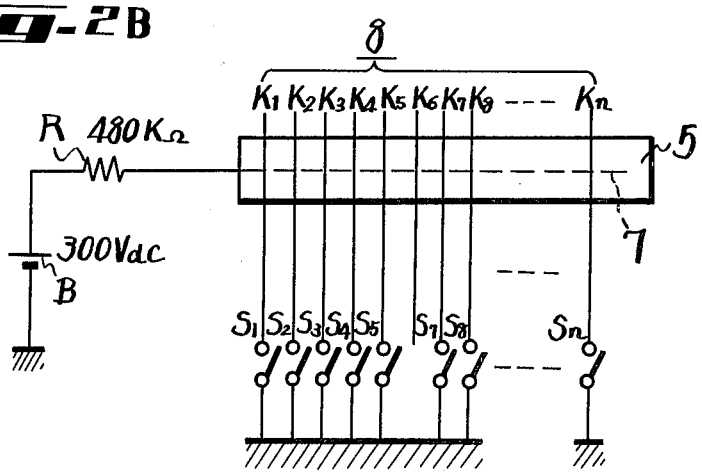
FIG. 2B is a schematic circuit diagram employed in experiments of spacer materials.

With such a construction, appli between selected ones of the cath ments $K_0$ and $A_0$ - - - produces a d aperture 4 of the spacer 5 corres secting point of the selected ca ments to emit glow light. Accor formed in the spacer 5 serve as In this case, the cathode an formed therein apertures 8*a* a those 4 of the spacer 5 so that t from the outside of the envel In FIG. 1A, a gas reservoir derside of the lower plate 3 reservoir 9 communicates through an aperture 9*a* fo sion. Between the reserv aforesaid exhaust pipe 9*b* 1*a* and the reservoir 9, an the exhaust pipe 9*b*. When consumed, it can be replaced As illustrated in FIG. 2A, the spacer 5 is formed of a conductive metal plate 5*a* which is covered with an insulating layer 5*b* over the entire areas thereof including the peripheral surface of the aperture 4. The insulating layer 5*b* is formed porous to permit the passage therethrough of electrons and ions which are produced upon discharge and this layer should not be formed as a dense layer such as glass or mica. The porous insulating layer 5*b* can be obtained by spraying a chromium oxide or alumina powder material onto both sides of e conductive metal plate 5*a* together with water glass d then baking the plate 5*a*. In this case, the insulating er 5*b* is required to have a heat resistance tempera- e higher than 400°C and, further, since a local mag- c field sometimes exhibits a particular high inten- during discharging of the discharge display device, nsulating layer 5*b* is required to have a uniform tand voltage higher than 250 $V_{ac}$. Therefore, it is red to check uniformity of the withstand voltage insulating layer 5*b* by measuring it, for example, measuring instrument employing a brush elecl manufacture of the discharge display device nvention in which the metal plate 5*a* and the were formed 0.25m/m and 0.4m/m thick, ely, and the insulating layer 5*b* was formed 7m/m in thickness, the results of measure- e withstand voltage of the insulating layer 5*b* bovesaid brush measuring instrument and a de were 10 MΩ and higher than 100 MΩ, ving will describe the operation of the dis- ay device of this invention employing the ned spacer 5, together with the results of ts conducted on the device. FIG. 2B is a ng diagram of the discharge display de- experiments in which a variety of spac- ernal power source, that is, a battery; R stor. The anode 7 is supplied with the ltage (about 300$V_{DC}$) through the re- ters $S_1$, $S_2$, - - - and $S_n$ identify resistance value of about 480 KΩ. of which the cathode elements $K_1$, respectively connected thereto are o the anode 7. In my experiments, - - and $S_n$ are adapted to be closed rting with the switch $S_1$, for exam- ntervals of 100 μsec (micro sec- er that turning-off of a preceding followed by turning-on of the om FIG. 2B, no switch is con- e element $K_0$. Consequently, h $S_5$ to $S_7$ is achieved directly at 0 μse. Further, selective dis- le 7 and the cathode 8 is pro- ire 4 shown in FIG. 1B, as aphs showing the results of ous spacers in the discharge d 3B respectively show the device employing, as the med of a glass pl ing a porous insulating plate, that is, the spacer In FIGS. 3A and 3B, reference character $P_1$ indicates instants of turning on the switch $P_2$ indicates firing instants. The firing instants each correspond to the highest potential and, at this instant, the potential is lost due to discharging.

Figure 3A:
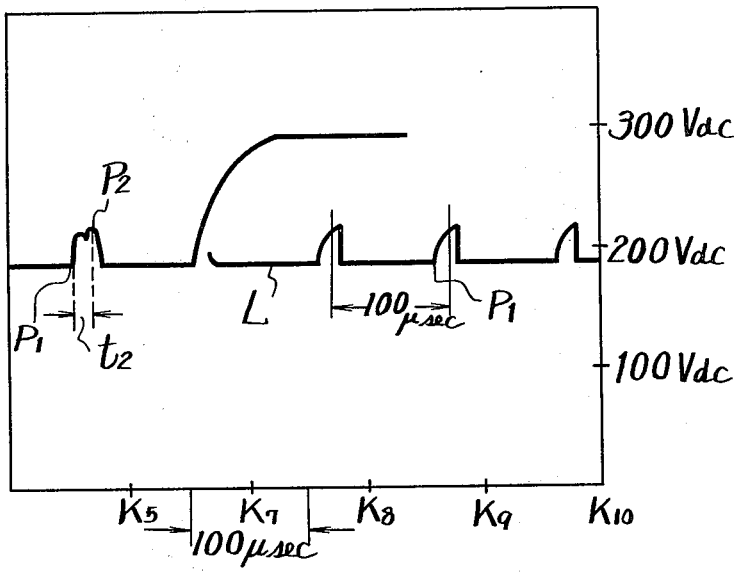
FIGS. 3A and 3B are graphs showing the discharging states in the cases of using various spacer materials, respectively.
Figure 3B:
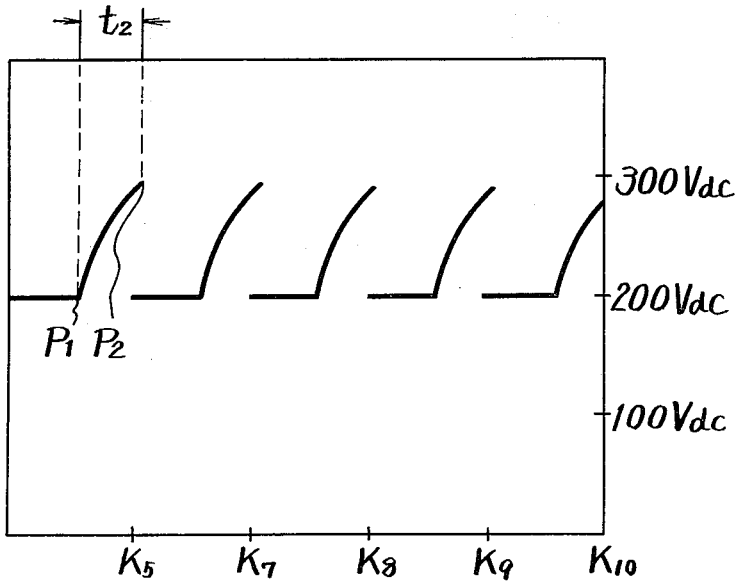

FIG. 3A indicates that, in the cathode element $K_7$, there are some occasions when the firing instant $P_2$ is delayed as compared with the others and no discharge is produced. In FIG. 3B, however, the cathode elements are discharged at substantially equal time intervals and, at this time, the potential of the spacer 5 is 135 $V_{DC}$ and no delay in discharging of the cathode element $K_7$ appears.

The reason for the difference in the firing potential between FIGS. 3A and 3B is that, in the experiments, the diameter of the aperture 4 of the spacer 5 and the thickness of the spacer 5 in the device of FIG. 3B were smaller and larger than those used in the device of FIG. 3A, respectively. Accordingly, as is evident from the FIGS., the time interval $t_2$ to the firing shown in FIG. 3B is long as compared with that shown in FIG. 3A.

As is seen from FIG. 3B, it may be considered that in the case of using the spacer of this invention, discharging of the cathode element $K_7$ is delayed because it is spaced away from the cathode element $K_5$. In practice, however, even if the spacing of the cathode 8 is large, it is not so much related to the discharge response time and, in my experiment, the discharge response time was short and the discharge is started positively.

The above is the experimental results, which will be theorized with reference to FIGS. 4 to 8. Generally, the response speed is dependent upon surroundings which determine the speed of electrons in the direction of the arrow *a* which are generated during discharging, that is, the conditions in the envelope 1*a*. The effect of the spacer will hereinafter be further described.

Figure 4:
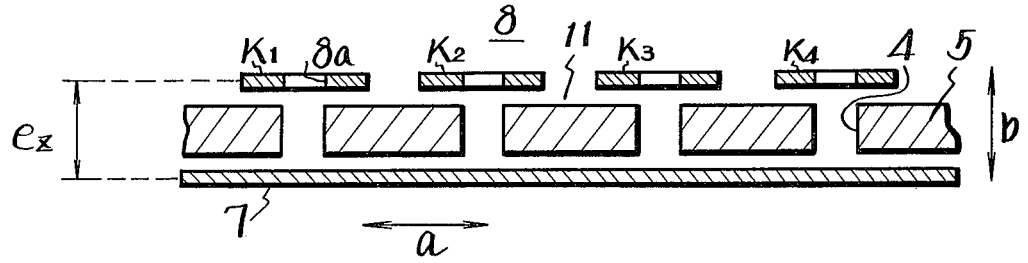
FIG. 4 is a cross-sectional view of the principal part of a discharge display device, for explaining it.
Figure 5:
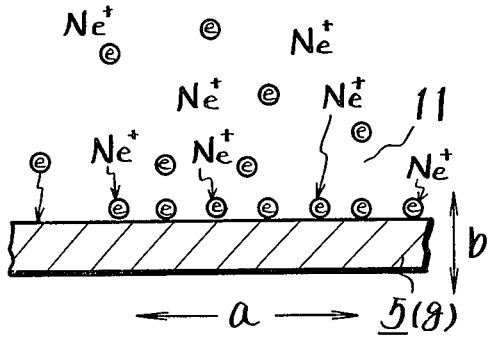
FIGS. 5 to 8 are schematic fragmentary diagrams, for explaining the discharging states in the cases of employing various spacers.
Figure 6:
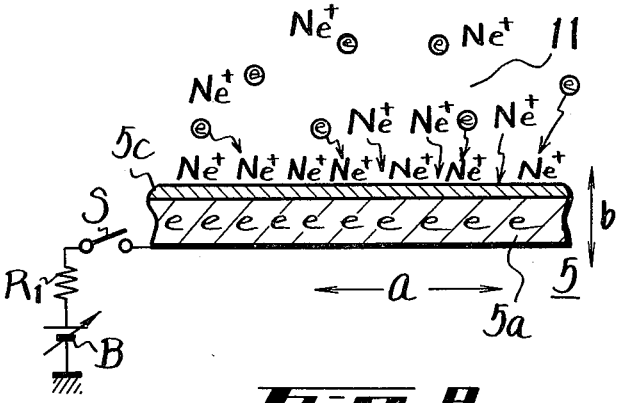
Figure 7:
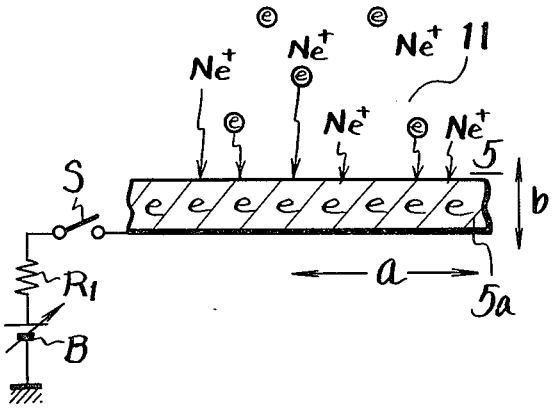
Figure 8:
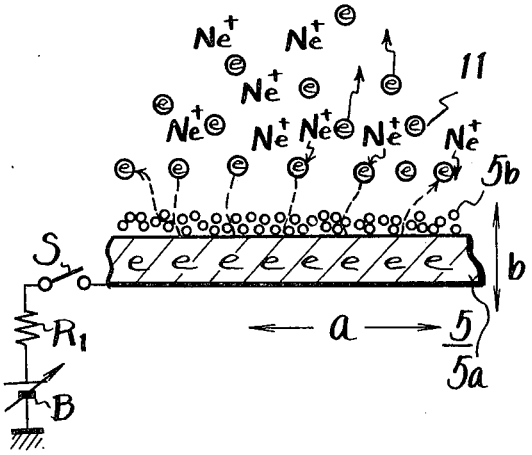

FIG. 4 is a fragmentary cross-sectional view showing the relationship between the anode 7 and the cathode 8 of a discharge tube. FIG. 5 is a cross-sectional view of the spacer 5 in which the spacer 5 is formed of a glass material *g*. FIG. 6 is a cross-sectional view of the spacer 5 in which a dense insulating layer 5*c* is deposited on a conductor, that is, the metal plate 5*a* and the metal plate 5*a* is adapted to be supplied with a voltage from a battery B through a resistor $R_1$ and a switch S. FIG. 7 is a cross-sectional view of the spacer 5 in which the insulating layer 5*c* on the metal plate 5*a* in FIG. 6 is removed. FIG. 8 is a cross-sectional view of the spacer 5 of this invention in which the insulating layer 5*c* in FIG. 6 is replaced with the insulating porous layer 5*b*. These figures illustrate the acting conditions of electrons *e* and neon ions $Ne^+$ during discharge. Reference numeral 11 identifies a plasma space in the discharge tube.

In the plasma space 11, during discharge, charged particles are diffused and recombined with one another to be extinguished. The charged particles do not so much have an affect on the other cathode elements spaced away from the cathode element being discharged. Since the ions are especially large in size compared with the electrons, they do not exhibit a strong tendency of not affecting the other cathode elements. The electrons *e* exert a greater influence on the formation of a neighboring discharge as compared with the ions, as described previously.

Accordingly, in FIG. 4, the spacing between the anode 7 and the cathode 8 in the direction *b* is dependent upon a voltage $e_z$ therebetween during discharge.

In fact, the magnetude of the voltage $e_z$ is related to the discharge of the next cathode element, but the speed of the electrons in the direction *a* perpendicular to the direction *b* has a strong relation to the discharge of the next cathode element and the start of discharge of the next cathode element is rapid.

By the way, in the case of FIG. 5, the electrons *e* produced by discharge readily adhere to the exposed glass surface as shown and attract ions to extinguish them, thus decreasing electrons promoting discharging of the next cathode element in the plasma space 11.

In the case of FIG. 6, neon ions are attracted to adhere to the surface of the insulating layer 5*c* and they are combined with electrons to provide the same results as shown in FIG. 5. Even if a voltage is applied to the metal plate 5*a* from the battery B, the same results are obtained.

Further, in the case of FIG. 7, when no voltage is applied, electrons decrease as in the case with FIG. 5. Upon application of a voltage, electrons *e* jump into a free electron layer on the conductor 5*a* more rapidly and ions are combined with free electrons, so that the same results are obtained.

In this case, by lowering the potential of the conductor 5*a* to the ground potential, electrons *e* are prevented from jumping into the conductor 5*a*, and consequently the amount of electrons *e* in the space 11 is increased, whereby the response time can be decreased. This results in a discharge between the anode 7 and the spacer 5, which implies that the spacer 5 serves as a cathode.

In FIG. 8 employing the spacer 5 of the present invention, the following assumption is probable. Namely, during discharging, electrons *e* generated in the plasma space 11 enter into the porous insulating layer 5*b* to lower its potential as compared with the conductor 5*a*. As a result of this, due to the intensity difference of the electric fields, the electrons go into the conductor 5*a* and propagate therein and, at the next discharging electrode position, they go out of the conductor 5*a* due to the electric field established between the anode 7 and the conductor 5*a*. However, these electrons of insufficient energy remain in the insulating layer 5*b* or on its surface and prevent movement of other electrons which are to enter into the conductor 5*a* from the plasma space 11 through the insulating layer 5*b*, or repel and direct them in the direction *a*, thus facilitating discharge of the next cathode element.

The following table shows the experimental values obtained with the spacers described above.

Table

| No | Materials of trial manufacture(spacer) | Measured Results: Distance between $K_1$ & $K_2$ (mm) | Measured Results: Delay of discharge time interval ($t_2$) of $K_2$ ($\mu$sec.) |
|---|---|---|---|
| 1 | Insulating material | 2.54 | 30–100 |
| | (the case of FIG. 5) | 7.5 | longer than 100 |
| 2 | Dense insulating material deposited | 2.54 | 30–100 |
| | on conductor | | |
| | (the case of FIG. 6) | 7.5 | 30–100 |
| 3B | Conductor | 2.54 | longer than 100 |
| | (the case of FIG. 7, +100V applied to | 2.54 | 80 |
| | conductor through resistor of 300KΩ) | 2.54 | longer than 100 |
| 4 | Metal spacer of this invention | 100 | 20 |
| | (the case of FIG. 8, +160V applied | 100 | 40 |
| | to metal plate through resistor of 300KΩ) | 7.5 | longer than 100 |

As is apparent from the above table, too, when the spacer of the present invention is used, even if the spacing between adjacent ones of the cathode elements is large, the response time interval is short and the discharge is carried out positively.

The discharge conditions shown in FIG. 3B can be understood from the above and the response time interval can be shortened. Accordingly, the discharge display device of this invention can be employed as a plasma display in place of a Braun tube as mentioned previously and the spacer which is used for graphic display and TV picture display can be produced at lower cost and with more accuracy than those formed of glass.

Although the present invention has been described in connection with a spacer interposed between the anode and the cathode in discharge display, the invention is not limited specifically thereto. A part such, for example, as the inside of the envelope, which is exposed to the plasma space produced by discharge or which is exposed to positive and negative charges, is formed with the material according to this invention so that a conductor is deposited with a porous insulating layer. As a result, the inside surface of the envelope thus formed shifts discharges rapidly.

With the present invention described above, the priming electrodes and isotopes used in the prior art become unnecessary.

It will be apparent that many modifications and variations may be effected by one skilled in the art without departing from the scope of the novel concepts of this invention.

I claim as my invention:

1. A discharge display device comprising:

a. upper and lower plates of which at least one is transparent;

b. an adhesive material sealing said upper and lower plates in an air-tight manner along their outer edges to form an envelope;

c. a spacer disposed between said upper and lower plates;

d. a plurality of cathodes disposed between said lower plate and said spacer;

e. at least one anode disposed in opposed relation to said plurality of cathodes and mounted between said upper plate and said spacer; and f. an inert gas sealed within said envelope; and said spacer formed of a conductive plate covered with an insulating layer of porous material.

2. A discharge display device comprising:

a. upper and lower plates of which at least one is transparent;

b. an adhesive material sealing said upper and lower plates in an air-tight manner along their outer edges to form an envelope;

c. a spacer disposed between said upper and lower plates;

d. a plurality of strip cathodes disposed side by side between said spacer and said lower plate and selectively supplied with a voltage;

e. a plurality of strip anodes disposed side by side between said spacer and said upper plate and extending at right angles to said plurality of cathodes;

f. an inert gas sealed within said envelope, and said spacer formed of a plate of conductive material covered with a layer of porous insulating material.

3. A discharge display device as claimed in claim 2, in which said spacer consists of a metal plate and a porous insulating layer formed on the surface of said metal plate.

4. A discharge display device as claimed in claim 3, in which said porous insulating layer contains chromium oxide powders.

5. A discharge display device as claimed in claim 3, in which said porous insulating layer contains alumina powders.

6. A discharge display device as claimed in claim 2, in which said lower plate is covered with an insulating porous layer on its inside surface.

7. A discharge display device as claimed in claim 6, in which the peripheral portion of said upper plate is covered with an insulating porous layer.

* * * * *